US008844963B2

(12) United States Patent
McCrank et al.

(10) Patent No.: US 8,844,963 B2
(45) Date of Patent: Sep. 30, 2014

(54) APPARATUS, KIT AND METHOD FOR TRIMMING A CLIMBING SKIN

(75) Inventors: Ernest Dawson McCrank, North Vancouver (CA); Cameron Allan Shute, Nelson (CA); Robert Erik Moore, North Vancouver (CA); Paul Matthew Palfreyman, Port Moody (CA); James William Rogers, North Vancouver (CA)

(73) Assignee: G3 Genuine Guide Gear Inc., North Vancouver (CA)

( * ) Notice: Subject to any disclaimer, the term of this patent is extended or adjusted under 35 U.S.C. 154(b) by 977 days.

(21) Appl. No.: 12/285,952

(22) Filed: Oct. 16, 2008

(65) Prior Publication Data

US 2010/0096838 A1 Apr. 22, 2010

(51) Int. Cl.
*A63C 7/04* (2006.01)

(52) U.S. Cl.
CPC ..... *A63C 7/04* (2013.01)
USPC ..... 280/604; 80/809; 30/289

(58) Field of Classification Search
USPC ..... 280/604; 30/286, 289, 293, 294, 295, 30/278, 279.2, 280, 287
See application file for complete search history.

(56) References Cited

U.S. PATENT DOCUMENTS

| | | | | |
|---|---|---|---|---|
| 3,276,119 | A * | 10/1966 | Brucker | 30/289 |
| 5,758,423 | A * | 6/1998 | Eversole et al. | 30/279.2 |
| 2006/0138747 | A1 * | 6/2006 | Hartmann | 280/604 |
| 2008/0185817 | A1 * | 8/2008 | Gyr | 280/604 |

OTHER PUBLICATIONS

Colltex, "Colltextra Saison 2006-2007", Sep. 2, 2007, p. 8.*
http://web.archive.org/web/20070902162748/http://www.colltex.ch/produkte/zuschneid.html, retrieved Aug. 23, 2013.*
G3 Genuine Guide Gear Inc. "07:08 Dealer Workbook" Jan. 2007; North Vancouver, Canada (cover and rear pages and p. 12).
G3 Genuine Guide Gear Inc. "08:09 Dealer Workbook"; printed Nov. 13, 2007; North Vancouver, Canada; (cover page, rear page and p. 23).
Dawson, L. "More or Show Highlights" [online] Jan. 28, 2008 [retrieved Feb. 4, 2009]. Retrieved from: <url:www.wildsnow.com> (3 pages).
G3 Genuine Guide Gear Inc. Product Insert for "Alpinist Climbing Skins"; printed Apr. 2008; North Vancouver, Canada. (English portion only, 2 pages).

* cited by examiner

*Primary Examiner* — Katy M Ebner

(57) ABSTRACT

A device for trimming a climbing skin to fit a snow travel aid such as a ski or snowboard is provided as well as a kit comprising such a device and at least one strip of climbing skin material. Also provided is a method of using the device. The device comprises: (a) a guide comprising a first surface for contact with a side of the snow travel aid and a second surface for contact with the snow travel aid base; and (b) a cutter connected to the guide opposite to the second surface, the cutter being offset from the first surface.

12 Claims, 10 Drawing Sheets

APPARATUS, KIT AND METHOD FOR TRIMMING A CLIMBING SKIN

FIELD OF THE INVENTION

This invention relates to climbing skins for use with snow travel aids such as skis, snowboards and sliding snow shoes.

BACKGROUND OF THE INVENTION

Climbing skins are used to assist a person on skis or another form of snow travel aid to ascend a slope. At one time, climbing skins were made from the skins of fur bearing animals. Modern climbing skins are manufactured and comprise material with a nap of fibres that project at similar angles. A strip of such material is attached to the base (undersurface) of a snow travel aid so that the fibres project outward and are angled rearwardly. This limits rearward slippage on snow while allowing relatively unimpeded forward sliding. Through the use of climbing skins, a user can ascend a relatively steep snow slope by sliding forward on one skin, and then the other.

Some snow travel aids are manufactured to include a permanent climbing skin attached to and usually embedded in, the base of the aid. In most situations, use of a removable climbing skin is preferred. Removable climbing skins are usually attached to the base of a snow travel aid by means of mechanical fasteners (such as straps or clips), glue or both. Glue for removable climbing skins is adapted to remain sticky at low temperatures and permit repeated removal and attachment of the skin from the base of the snow travel aid.

Material for removable climbing skins is available in a variety of widths. Typically, a user will acquire a sufficient length of the material to cover the bottom of the snow travel aid from approximately end to end. The user may select a pre-cut strip of material having a width less than the narrowest portion of the aid's base (i.e., the "waist" of a ski). Due to the shape of the bottom surface of many modern sliding snow travel aids, fitting a climbing skin in this manner will leave forward and rearward portions of the base not covered by the material. Exposed areas of the base reduce the amount of grip that may be possible between the aid and snow and also provides areas which if weighted, may result in rearward slippage on the snow. To compensate, a user may trim the lateral edges of a strip of climbing skin material to match each side contour of the base of the snow travel aid thereby permitting the material to cover more of the base. However, if a climbing skin is trimmed so that the skin material extends right to each bottom side edge on the base, the user may then encounter difficulties in "setting" an edge when needed on icy surfaces because the bottom surfaces of the edges are covered. This is particularly a problem with the hard bottom side edges (e.g., metal edges) typically provided on the base of a sliding snow travel aid which are intended to bite into ice and hard snow. To compensate for the latter disadvantage, a user may trim the lateral edges to provide a small offset from the side of the snow travel aid thereby exposing a portion of the base of the aid adjacent the edge.

Trimming climbing skins apart from a snow travel aid to provide an offset can be done by measurement or approximation and can also be done using the aid as a pattern. The latter procedure is accomplished by positioning a strip of climbing skin material against the base and covering both side edges of the aid. The user then trims a first side using a blade held against one edge of the aid as a guide. This results in the first side being trimmed to exactly match the contour of one side edge of the aid. The climbing skin is then repositioned on the base by moving the material a certain distance laterally away from the trimmed side, followed by trimming of the second side in the same manner as the first. The lateral distance is chosen to be double the desired offset between one side edge of the aid and the corresponding climbing skin edge. The skin is then repositioned centrally on the base so that each edge of the climbing skin is offset inwards from the corresponding base side edge the desired amount so as to reveal both side edges on both sides of the aid. For example, when the aid comprises the metal bottom side edges typical of a modern downhill or touring ski or a snowboard, the offset is usually selected so as to reveal at least the entirety of the underside of each metal edge.

SUMMARY OF THE INVENTION

Various embodiments of this invention provide a device for trimming a climbing skin to fit a snow travel aid base, the device comprising: (a) a guide comprising a first surface for contact with a side of the snow travel aid and a second surface for contact with the snow travel aid base; and (b) a cutter connected to the guide opposite to the second surface, the cutter being offset from the first surface.

Other embodiments of this invention provide a method of trimming a climbing skin to fit a snow travel aid base with a trimming device, the device comprising: (i) a guide comprising a first surface for contact with a side of the snow travel aid and a second surface for contact with the snow travel aid base; and (ii) a cutter connected to the guide opposite to the second surface, the cutter being offset from the first surface; wherein the method comprises: (a) positioning a climbing skin on the snow travel aid base; (b) positioning the device with said first surface in contact with the snow travel aid side and said second surface in contact with the snow travel aid base, the second surface being positioned between the climbing skin and the base; and (c) drawing or pushing the device while maintaining said contact of the first and second surfaces, whereby the cutter trims the climbing skin along a line offset from the snow travel aid side.

Other embodiments of this invention provide a kit comprising at least one strip of climbing skin material and a device for trimming the climbing skin to fit a snow travel aid base, the device comprising: (a) a guide comprising a first surface for contact with a side of a snow travel aid and a second surface for contact with a side of the snow travel aid base; and (b) a cutter connected to the guide opposite to the second surface, the cutter being offset from the first surface.

This invention permits trimming of a climbing skin to fit the base of a ski or other snow travel aid using the base as a pattern, without having to reposition the climbing skin to provide offset on both sides of the climbing skin so as to expose bottom side edges along both sides of the snow travel aid.

DETAILED DESCRIPTION OF PARTICULAR EMBODIMENTS

Figure 1B:
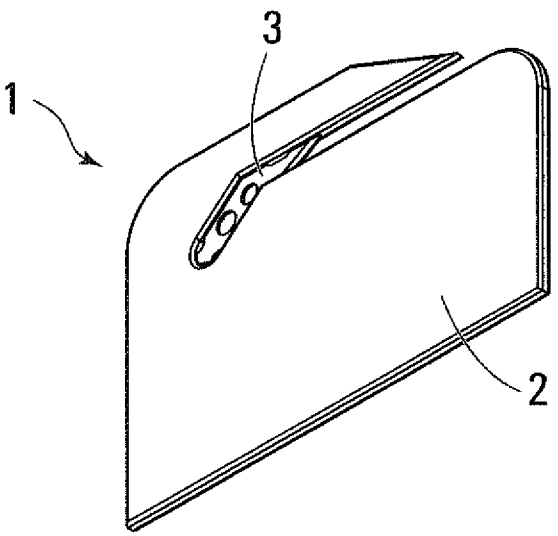
FIG 1B Prior Art
FIGS. 1A and 1B are side and perspective views, respectively, of a prior art "letter-opener" style climbing skin trim tool.

Snow travel aids as contemplated herein are those aids which may be used with a removable climbing skin. Typically, such an aid is adapted to slide on the snow surface. Examples include skis and any sliding snow travel aid shaped like a ski. Examples of the latter aids include devices known as "ski blades", "snow blades", "ski boards", as well as "sliding" or "gliding snow shoes". An example of the latter snow travel aid is the configurable snow shoe/ski device described in WO 2000/044846. In this specification, the term "ski" will apply to any sliding snow travel aid which has a ski-like shape and is used in pairs. This includes ski/snow shoe hybrids which are adapted to slide on the snow surface. In this specification, the term "snow travel aid" also includes snowboards which are adapted for use with climbing skins. This includes the devices known as "split-boards" which are snowboards that can be separated longitudinally into at least two separable portions, the two portions then functioning in a manner similar to skis. In this specification, reference to "snowboard" includes reference to an individual separable portion of a "split-board".

A device of this invention will comprise a guide which, when in use, is intended to follow the bottom side edge of a snow travel aid. The guide will comprise a first surface for contact with the side of the snow travel aid and a second surface for contact with the base of the aid. These surfaces may be adapted to simply slide along the side and base or may include additional elements such as bearings to minimise resistance when in use. The surfaces may be on separate, connected parts or may join to form an inside corner. The guide may be configured so that the first and second surfaces are positioned generally perpendicular to each other. In such embodiments, parts of the guide which bear the first and second surfaces may also be oriented in a generally perpendicular fashion.

The term "generally perpendicular" in the context of this specification does not mean 90° but rather refers to a particular orientation of components so that one extends from another in a generally perpendicular fashion. Without limiting this term, an angle formed between one component that is "generally perpendicular" to the other may be any particular value or range of values falling within the range of about 45° to about 135°, including about 90°.

A guide of this invention will also comprise a cutter connected to the guide and positioned to be opposite to the second surface. Thus, the cutter extends away from a part of the guide that bears the second surface in a direction opposite to the second surface. In some embodiments, the cutter may be positioned generally perpendicular to the second surface. The cutter is also positioned to be offset from the first surface. Thus, the cutter will be positioned on a part of the guide bearing the second surface a distance away from an actual or notional intersection of the first surface with the second surface. The offset may be any amount which will expose the snow travel aid edge, including a distance of about 1 mm to about 10 mm. In particular embodiments, the offset will be less than 10 mm. In certain embodiments, the offset may be about 2 mm to about 8 mm, about 3 mm to about 6 mm, about 4 or 5 mm, or any particular value within these ranges. Offsets of about 3, 4, 5, or 6 mm will provide clearance for most metal edges of snow travel aids while minimising the amount of the base that is exposed. In some embodiments of this invention, the device is adapted to provide for adjustment of the offset for custom trimming of a climbing skin to provide a particular offset.

A device of this invention may comprise a handle to assist a user in drawing or pushing the device along the edge of a snow travel aid while trimming climbing skin material. In some embodiments, the handle is connected to the guide opposite to the first surface. In some embodiments, the handle may be shaped to facilitate being gripped by the user. An example of shaping to facilitate gripping would be to shape the handle to match contours of a user's thumb and/or fingers. Another example is the placement of serrations or corrugations or the like on the handle to improve grip.

The cutter of a device of this invention may be any implement suitable for cutting climbing skin material. In some embodiments, this is provided by a blade or more than one blade. In some embodiments, the device comprises two blades, oriented in opposite directions to facilitate trimming of the climbing skin material in either direction. The blade or blades may be mounted in a blade holder. In some embodiments, the blade or blades are removable in order to facilitate their replacement. In disposable embodiments, the blade holder and guide may be of one-piece construction and the blade or blades embedded therein. The guide and handle or the guide, handle and blade holder may also be of one-piece construction.

Typically, the cutter will extend outward from a part of the guide which comprises the second surface so that the cutter extends opposite to the second surface. In some embodiments, the cutter will be generally perpendicular to the second surface in which case the blade or blades may be oriented in a generally perpendicular fashion relative to a part of the guide comprising the second surface. The blade or blades may be positioned approximately parallel in orientation to the first surface while being offset from that surface.

Within the context of this specification, the term "approximately parallel" includes but is not limited to what is exactly parallel. For example, approximately parallel surfaces may converge at a notional angle of more than 0° and less than about 45° or at any angle or range of angles therebetween.

When a glued climbing skin is positioned on the base for trimming, the adhesive backing of the skin will usually be adhered to the base. A part of the guide which bears the second surface is intended to be positioned between the climbing skin and the base. Some embodiments of this invention provide a feature or features which assist the user in maintaining contact of the device against the side of the snow travel aid while the user draws or pushes the device along a base side edge of the aid. This feature is the presence, on a leading side of a part of the guide that comprises the second surface, of a projection that narrows to a tip positioned away from the first surface. The leading side is the side that precedes the remainder of the part when the device is pushed or drawn along a base side edge of a snow travel aid. In embodiments of this invention adapted to trim a climbing skin in either direction, such a projection may be provided on each leading side. When viewing the part that comprises the second surface in plan orientation, the profile of that part may reveal a generally triangular shaped projection or projections, each having an apex positioned away (distal) from the part of the guide which bears the first surface. In some embodiments, the part of the guide which comprises the second surface may have the shape of a trapezium in plan view, thereby providing such a projection on each of the two sides of the part which act as leading sides when the device is drawn or pushed along the base side edge of a snow travel aid. Such a projection or projections on the leading edge(s) act like a wedge which tends to drive between a glued climbing skin and the base of the snow travel aid while the device moves along the base side edge, thereby tending to keep the device in contact with the side of the snow travel aid.

A part of the guide which comprises the second surface may be of sufficient width relative to the first surface that the user can easily maintain contact of the second surface on the base while drawing or pushing the guide along the snow travel aid. Particular embodiments of this invention do not include any unnecessary width for this part of the guide other than what is useful for maintaining contact with the base, to provide the desired offset of an attached cutter and/or to provide a projection on a leading edge, as described above. Glue on the portion of the climbing skin overlying the guide can cause resistance and unnecessary material in the width of that part of the guide may make it more difficult to draw or push the device along the snow travel aid. It can also be advantageous to minimise the thickness of the part of the guide that bears the second surface to facilitate passage of this part between the climbing skin material and the base. Embodiments of this invention may also contain features on the part that bears the second surface to minimise drag, such as the use of materials which minimise adhesion or materials containing serrations or corrugations to minimise contact with the glued surface of the climbing skin.

The width of the guide part bearing the second surface as measured from the first surface may be more or less than about 5 mm. In other embodiments, the width will be less than about 25 mm. In some embodiments, the width will be about 5 mm to about 25 mm. In other embodiments, the width will be about 10 mm to about 20 mm or about 15 mm. The thickness of the guide part may be over 5 mm but is advantageously dimensioned to be less than this amount. For example, the thickness may range between about 1 mm and 5 mm or any individual thickness or range of thicknesses between those amounts. In some embodiments, the maximum thickness of this part may be about 2 mm. Furthermore, one or more edge portions (particularly leading edge portions) of this part may be tapered in the thickness of the portion to provide a knife-like edge, thinner than the remainder of the part. Such tapering can facilitate forward and rearward travel of the device between climbing skin material and the base of a snow travel aid.

A device of this invention may be provided to a user as part of a kit further comprising at least one strip of climbing skin material. A kit may comprise a pair of strips of climbing skin material pre-cut to a particular width and length which the user selects based on the dimensions of the user's snow travel aid. Such a kit may further comprise packaging material for the climbing skin material and the trimming device. The kit may further comprise one or more devices or apparatus for affixing one or both ends of the climbing skin material strip to the tip and/or tail of a snow travel aid. Such a kit may further comprise printed instructions for use of the device to trim the strip of climbing skin material to fit the base of a snow travel aid in accordance with the teachings herein.

Particular embodiments of this invention will now be illustrated by reference to the attached drawings.

Figure 1A:
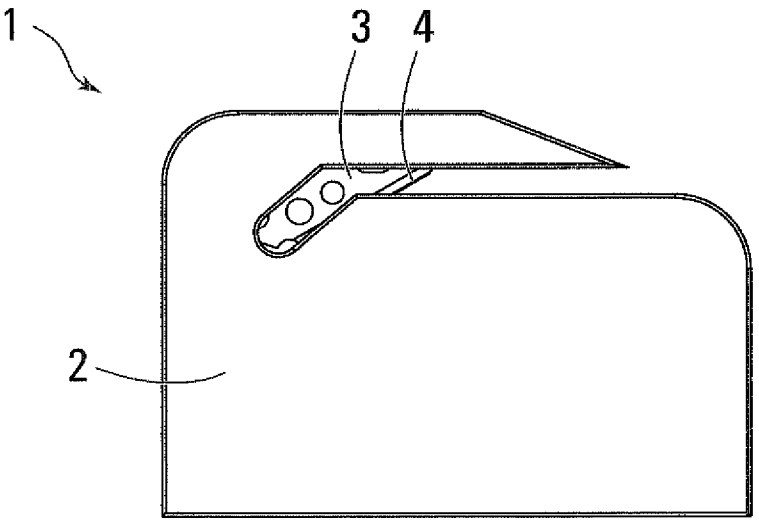
FIG 1A Prior Art

The advantage provided by a device of this invention is conveniently illustrated by reference to a prior art device. FIGS. 1A and 1B show a "letter opener" style climbing skin trim tool. Such tools were included in kits sold by G3 Genuine Guide Gear Inc. of North Vancouver, British Columbia, Canada, together with strips of climbing skin material. Tool 1 consists of a combination handle and blade holder portion 2. Portion 2 is typically made of a thermal-moulded plastic. Moulded into the blade holder is blade 3 which comprises cutting edge 4.

Figure 2:
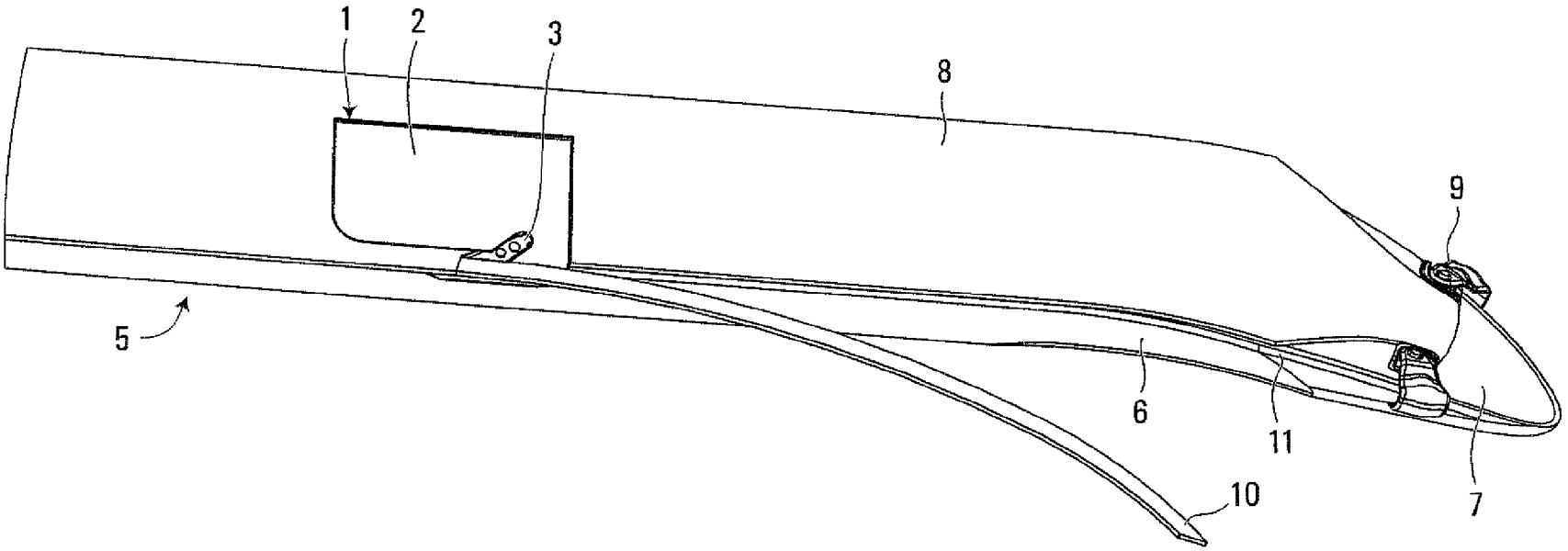
FIG. 2 Prior Art
FIG. 2 is a partial perspective view showing the undersurface of the front end of a ski with attached climbing skin being trimmed by the prior art trim tool shown in FIG. 1.
Figure 3:
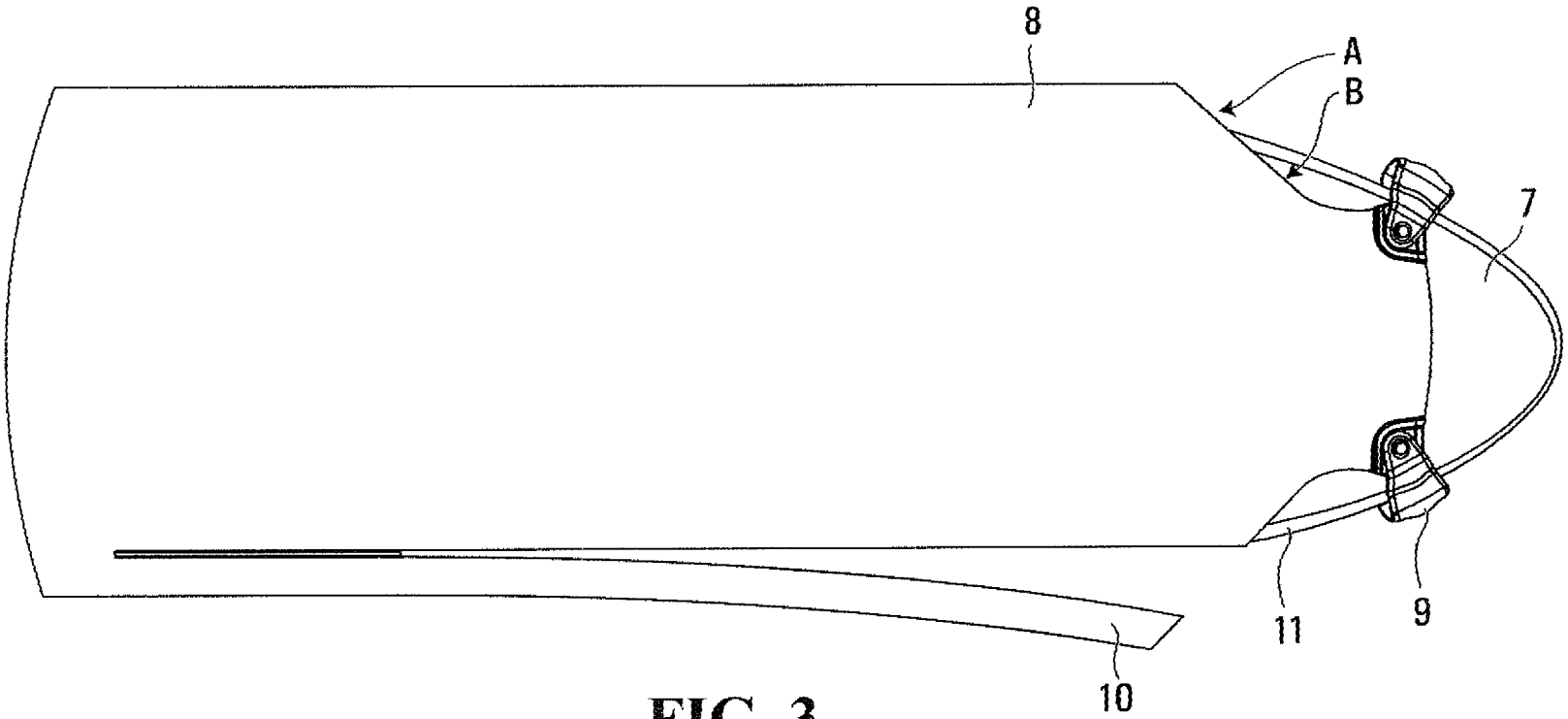
FIG. 3 Prior Art
FIG. 3 is a partial bottom view showing the front end of a ski and climbing skin as in FIG. 2 with the prior art trim tool removed.
Figure 4:
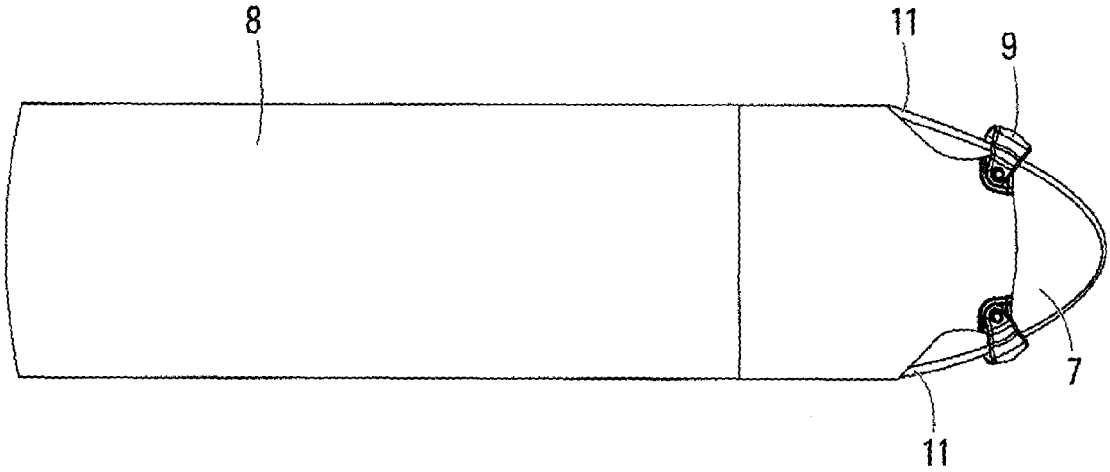
FIG. 4 Prior Art
FIG. 4 is a partial bottom view of the front end of a ski and climbing skin with both sides of the climbing skin trimmed as in the prior art.

FIG. 2 shows the prior art tool in operation to trim a climbing skin to fit a ski. As illustrated, ski 5 comprising ski side 6 and ski base 7 is fitted with a strip of climbing skin material 8 which is positioned to cover base 7 except in a small region adjacent the ski tip. The front end of the climbing skin is fastened to the ski tip by clip 9. Material 8 may have an adhesive backing which is used to adhere the material to the remainder of the ski base. A side of tool 1 is placed flat against ski side 6 and the tool drawn rearward, engaging blade 3 with material 8 and resulting in portion 10 being cut away. As is shown in FIG. 3 (with the tool absent), the material 8 is trimmed in such a way that the edge of the trimmed material closely follows the contours of metal edge 11 of ski 5. Once portion 10 is removed from the entire length of the climbing skin material, the tool is then positioned at an opposite side of the ski so that the blade contacts the skin material at the point marked by the arrow labelled "A" and the process repeated. The end result is shown in FIG. 4, where in bottom view, it is seen that the trimmed material 8 covers ski edges 11 on both sides of the ski. To avoid this outcome, the climbing skin material may be repositioned on the base of the ski away from the first trimmed side so that when the second side is trimmed, the blade engages material 8 at approximately the point labelled "B". The end result will be a trimmed climbing skin which, when centred on the base of the ski exposes edge 11 along both sides of the ski.

Only the front portion of the ski and climbing skin is illustrated in FIGS. 2 to 4. Typically, the climbing skin material will extend rearward towards the tail of the snow travel aid and may cover the entire length or nearly the entire length to the tail of the snow travel aid.

Figure 5C:
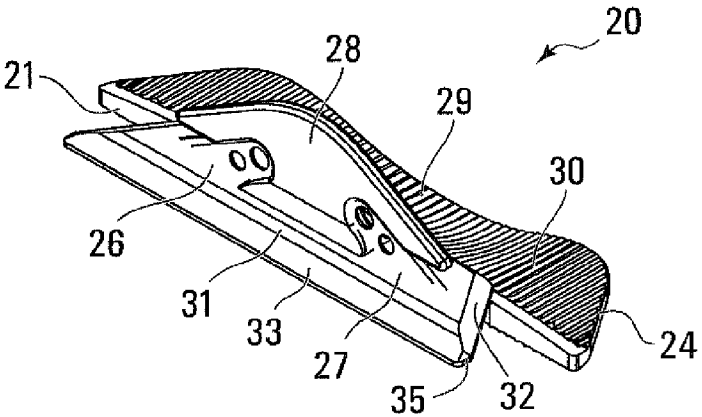
FIGS. 5A-5C are end, side and perspective views, respectively of a device of this invention.
Figure 5B:
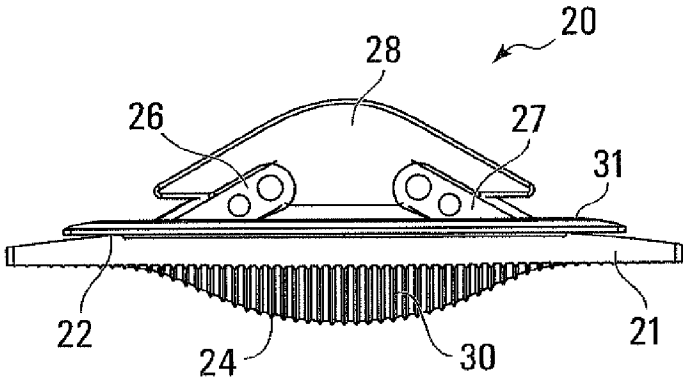
Figure 5A:
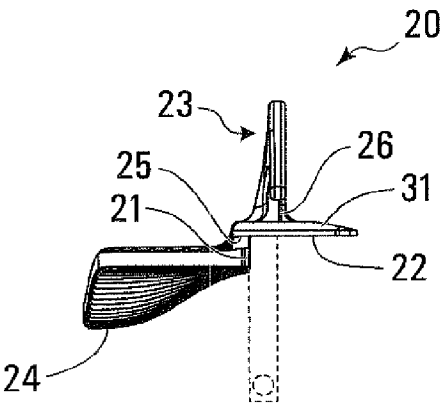

FIGS. 5A-5C show a particular embodiment 20 of a device of this invention. As shown in FIG. 5A, the device contains a guide which presents first surface 21 and second surface 22 oriented in a generally perpendicular manner to each other and forming inside corner 25. Surface 22 is intended to contact the base of a snow travel aid. Surface 21 is intended to contact a side of a snow travel aid. When both surfaces are in such contact, inside corner 25 as present in this embodiment will contact the very edge of the snow travel aid (which is often a metal edge). In some embodiments, clearance may be provided in this region of corner 25 to accommodate different edge configurations. Attached to the guide on part 31 and extending opposite to surface 22 is cutter 23 which presents blade 26 offset from surface 21 (space "C" in FIG. 5A). Attached to the guide and extending generally perpendicular from surface 21 is handle 24.

The embodiment shown in FIG. 5B comprises two blades 26 and 27 oriented in opposite directions to facilitate cutting of the climbing skin material in forwards or backwards directions. With such an embodiment, the user may elect to cut the climbing skin on each side starting at either the front or the rear of the snow travel aid by simply pushing or drawing the device, as the case may be. In the illustrated embodiment, cutter 23 comprises blade holder 28 in which blades 26 and 27 are embedded. Also, blade holder 28, the guide portion of the device comprising surfaces 21 and 22 and the handle 24 are of one-piece construction, in this case a thermal-moulded plastic. However, any suitable materials will suffice.

As shown in FIG. 5C, the illustrated embodiment has an ergonomically shaped handle 24 which comprises depression 29 adapted to engage the fleshy part of a user's thumb. In order to further increase grip, handle 24 comprises serrations 30. Also shown in FIG. 5C are tapered portions 32 and 33 of part 31 which provide knife-like edges that are thinner than the remainder of the part. Portion 32 provides a leading edge in one direction to reduce resistance when the device is in use. A corresponding leading edge may be present at the opposite end of part 31. Tapered side portion 33 may also assist in minimising resistance.

Figure 6:
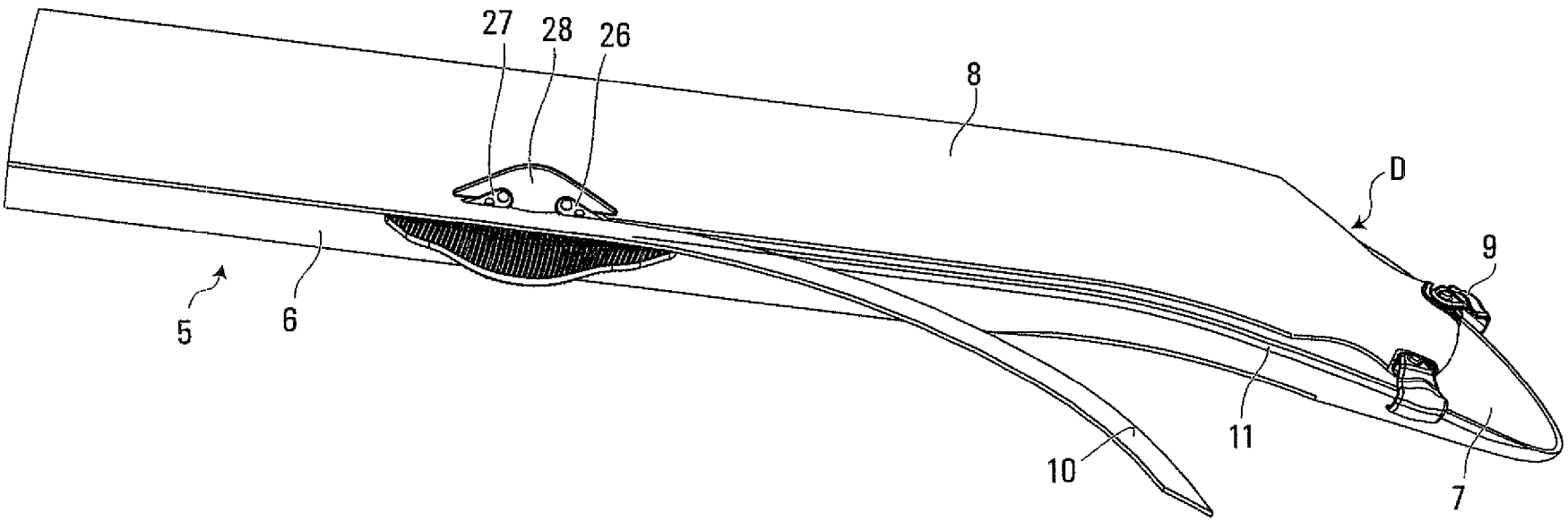
FIG. 6 is a partial bottom view showing the front end of a ski with attached climbing skin, one side of which is trimmed with a device of this invention.

FIG. 6 shows the use of a device of this invention trimming one side of a climbing skin arranged on a ski. In use, part 31 is positioned between the climbing skin material 8 and the base. The device is drawn or pushed along the edge of the snow travel aid with a side portion of the climbing skin material which is adjacent the side of the aid riding over part 31. Handle 24 extends laterally to enable the user to grip it and (as is the case of FIGS. 6 and 7) to draw the device rearward, cutting away remnant 10.

Figure 7:
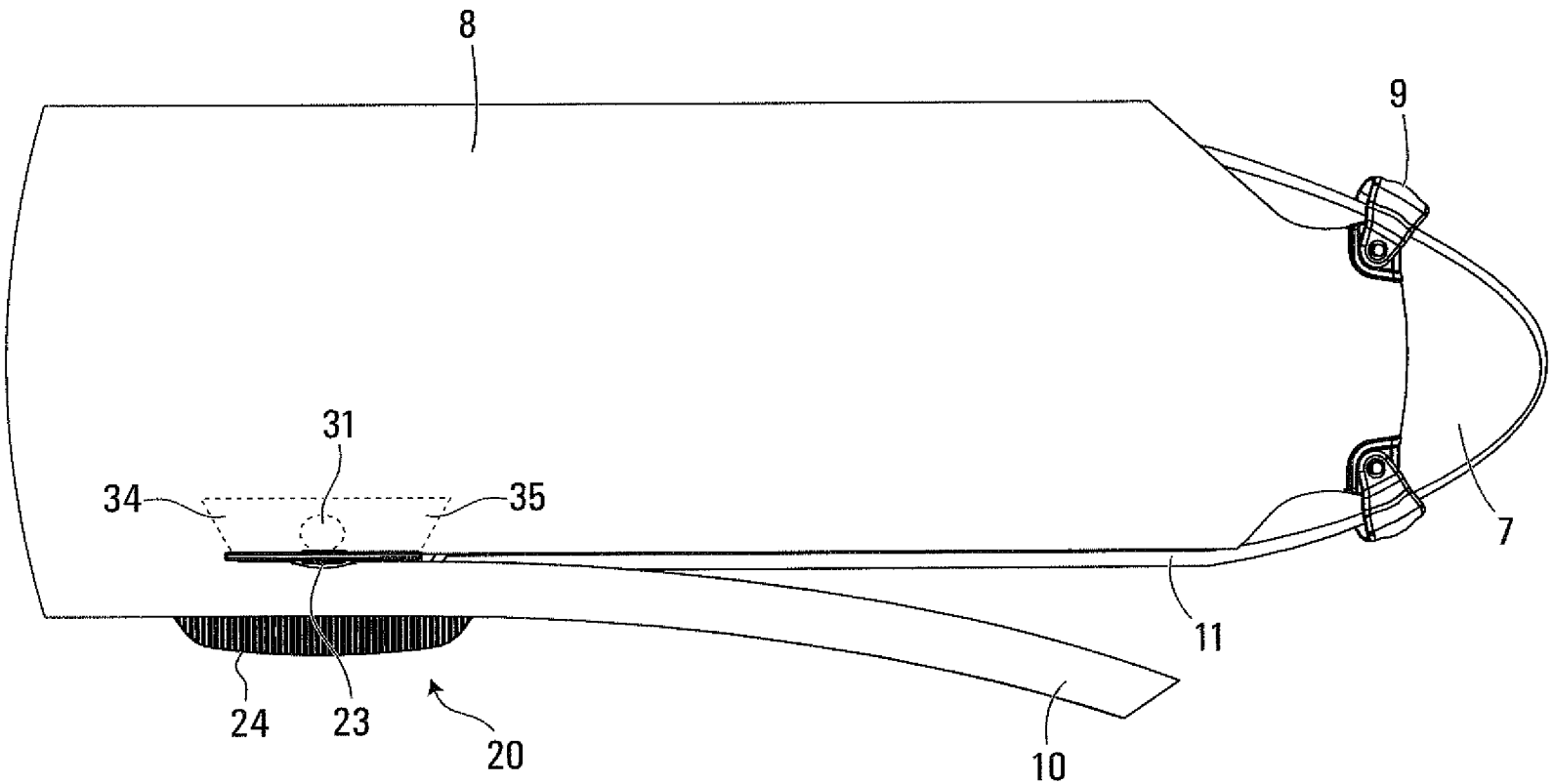
FIG. 7 is a partial perspective view showing the front end of a ski and climbing skin trimmed with the device shown in FIG. 6.

The perspective view in FIG. 7 shows the cutter 23 comprising blade holder 28 and blades 26 and 27. As shown, blade 27 is performing the illustrated cut. When this first cut is completed, the device is rotated so that handle 24 will extend away from the opposite edge of the snow travel aid. The user may then engage the device either at the rear or the front of the aid, for example, at point "D" as illustrated in FIG. 7. If a single blade is present, the user will have to commence the second cut at the opposite end of the aid from the end where the first cut was commenced.

Illustrated by phantom lines in FIG. 7 is part 31, which in this embodiment has a trapezium shaped profile in plan view. Part 31 is positioned (sandwiched) between climbing skin material 8 and base 7. Shown in FIG. 7 are triangular shaped projections 34 and 35, each on a leading edge of the second surface and each having an apex positioned away (distal) from the first surface. These projections act like wedges and tend to drive between a glued climbing skin and the base. This feature facilitates maintaining contact of the device on the side of the snow travel aid while the device is pushed or drawn along a base side edge of the aid.

Figure 8:
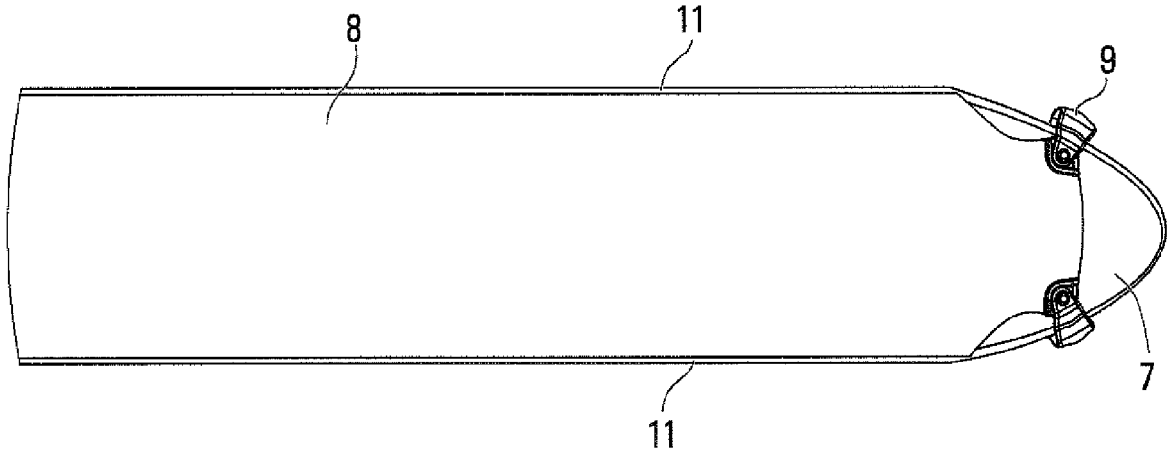
FIG. 8 is a partial bottom view of the front end of a ski and attached climbing skin, both sides having been trimmed by a device of this invention.

FIG. 8 illustrates the final result after both sides of the climbing skin shown in FIGS. 6 and 7 is trimmed. Without repositioning the material, one is able to provide a trimmed climbing skin which exposes edges 11 on both sides of the ski.

As was the case with the previous drawings, the rear portion of the snow travel aid and accompanying climbing skin is not illustrated in FIGS. 6-8.

Figure 9:
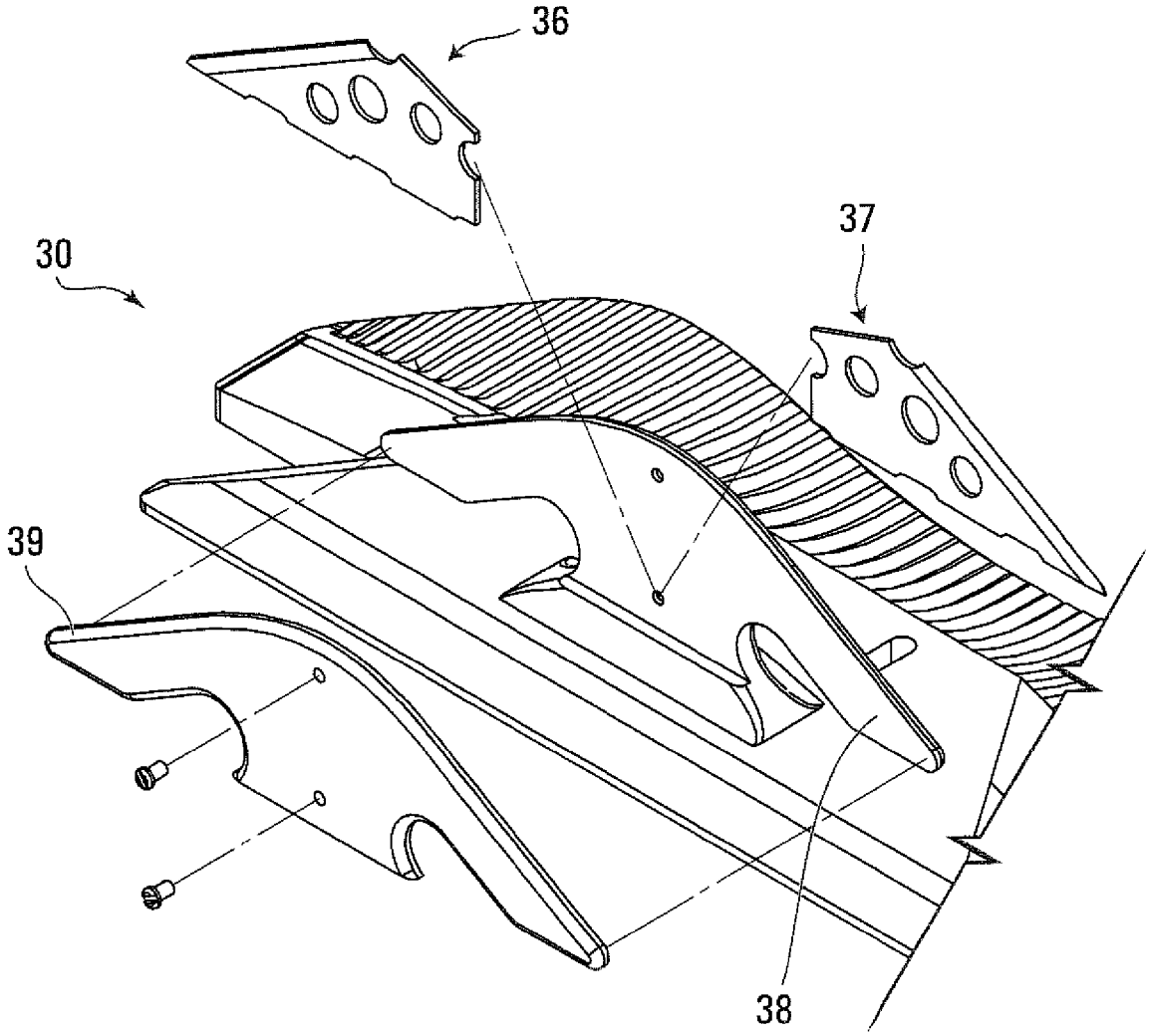
FIG. 9 is a partial, exploded perspective view of a device of this invention with a removable blade.

FIG. 9 illustrates an alternate embodiment of this invention. Device 30 comprises removable blades 36 and 37. As shown by phantom lines, the removable blades may be sandwiched between two halves 38 and 39 of a blade holder. In this embodiment, the two halves are attached by means of threaded fasteners 40. A variety of other known means for providing a replaceable blade in a cutting instrument may be adapted for use in a device of this invention.

Figures 10A, 10B:
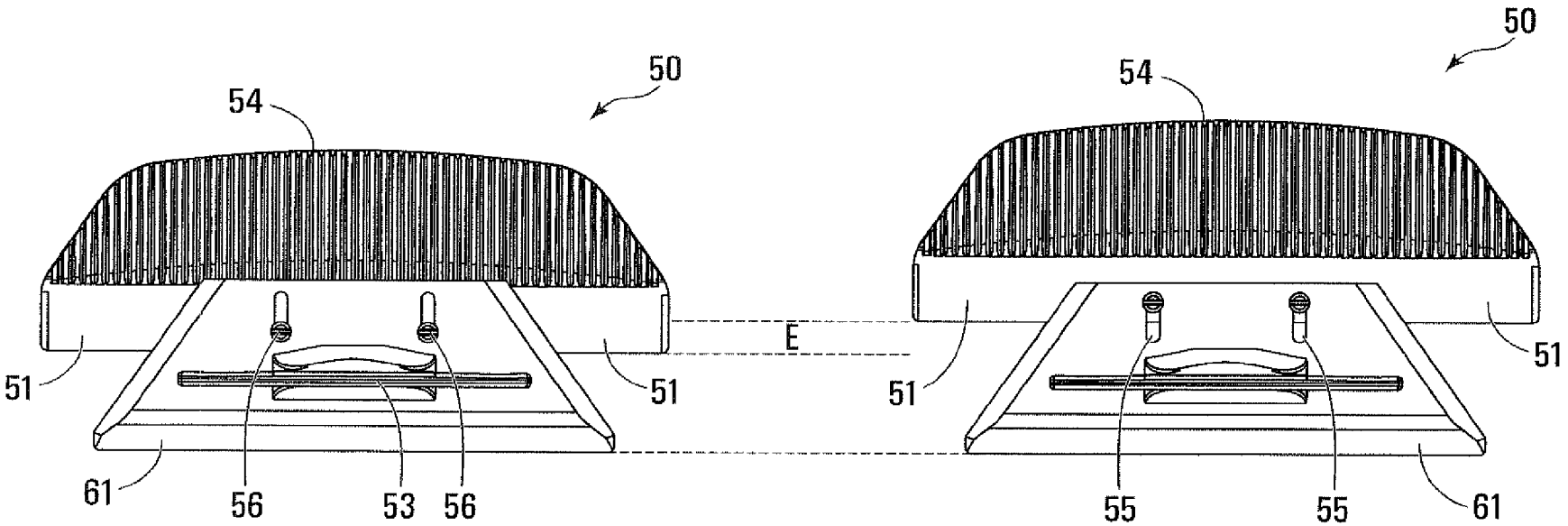
FIGS. 10A and 10B are top views of an embodiment of a device of this invention which has adjustable offset.

FIGS. 10A and 10B show a further embodiment in which the offset is adjustable. In device 50, adjustability is provided by moving part 61 of the guide which bears the surface for contact of the base of a snow travel aid. This surface is on the underside of part 61 in the drawing. Part 61 is moveable relative to the portion of the guide which bears surface 51 that contacts the side of the snow travel aid. In this embodiment, handle 54 is attached to the part of the guide bearing surface 51. Part 61 is connected to the remainder of the guide by means of threaded fasteners 56 which pass through slots 55 in part 61. This provides for an adjustable offset in an amount corresponding to the length of slots (represented by distance "E"). Device 50 shown in FIG. 10A is set for the minimum offset whereas the device 50 in FIG. 10B is set to provide maximum offset. Other known means for juxtaposing and retaining components at a fixed distance may be employed to provide adjustable offset in this invention.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the appended claims.

What is claimed is:

1. A device for trimming a climbing skin to fit a snow travel aid base, the device comprising:

(a) a guide comprising first and second parts, the first part comprising a first surface for contact with a side of the snow travel aid and the second part comprising a second surface for contact with the snow travel aid base; and (b) a cutter extending from the second part opposite to the second surface, at a position offset from the first surface;

wherein a leading side of the second part extends in a direction away from the first surface and is inclined towards a cutting direction of the device forming a wedge, wherein the device is configured such that during use, the first surface of the first part contacts a side of a snow travel aid and the second surface of the second part simultaneously contacts a base of the snow travel aid such that the device may be slid along the side of the snow travel aid to engage the cutter with a climbing skin adhered to the snow travel aid base while the wedge drives between the climbing skin and the snow travel aid base to facilitate maintenance of contact of the first surface with the side of the snow travel aid base.

2. The device of claim 1 further comprising a handle.

3. The device of claim 1, wherein the offset is adjustable.

4. The device of claim 1, wherein the offset is a distance from about 1 mm to about 10 mm.

5. The device of claim 1, wherein the cutter comprises at least one blade.

6. The device of claim 1, wherein the cutter comprises blades for trimming in opposite directions.

7. A method of trimming a climbing skin to fit a snow travel aid base with a trimming device, the device comprising:

(i) a guide comprising first and second parts, the first part comprising a first surface for contact with a side of the snow travel aid and the second part comprising a second surface for contact with the snow travel aid base; and (ii) a cutter extending from the second part opposite to the second surface, at a position offset from the first surface;

wherein the method comprises:

(a) positioning a climbing skin on the snow travel aid base;

(b) positioning the device with said first surface in contact with the snow travel aid side and said second surface in contact with the snow travel aid base, the second surface being positioned between the climbing skin and the base; and (c) drawing or pushing the device while maintaining said contact of the first and second surfaces, whereby the cutter trims the climbing skin along a line offset from the snow travel aid side.

8. The method of claim 7, wherein the climbing skin is adhered by glue to the snow travel aid base in step (a).

9. The method of claim 8, wherein the second part comprises one or more sides that are tapered to an edge to facilitate travel of the second part between the climbing skin and the snow travel aid base when the climbing skin is adhered to the snow travel aid base.

10. The method of claim 8, wherein the device further comprises means for facilitating maintenance of contact of the first surface with the side of the snow travel aid during said drawing or pushing of the device and the means for facilitating maintenance of contact comprises a leading edge of the second part that extends in a direction away from the first surface and is inclined towards a cutting direction of the device, wherein during said drawing or pushing of the device with the climbing skin adhered to the snow travel aid base, the leading edge drives between the climbing skin and the snow travel aid base.

11. The method of claim 7, wherein the device further comprises means for facilitating maintenance of contact of the first surface with the side of the snow travel aid during said drawing or pushing of the device.

12. A kit comprising at least one strip of adhesive-backed climbing skin material and a device for trimming the climbing skin to fit a snow travel aid base, the device comprising:

(a) a guide comprising first and second parts, the first part comprising a first surface for contact with a side of the snow travel aid and the second part comprising a second surface for contact with the snow travel aid base; and (b) a cutter extending from the second part opposite to the second surface, at a position offset from the first surface;

wherein the second part comprises at least one leading side that is tapered in thickness forming a leading edge and wherein the leading side also extends in a direction away from the first surface and is inclined towards a cutting direction of the device forming a wedge, wherein the device is configured such that during use, the first surface of the first part contacts a side of a snow travel aid and the second surface of the second part simultaneously contacts a base of the snow travel aid such that the device may be slid along the side of the snow travel aid to engage the cutter with a climbing skin adhered to the snow travel aid base while the wedge drives between the climbing skin and the snow travel aid base.

* * * * *